US005868633A

United States Patent [19]

Keheley

[11] Patent Number: 5,868,633

[45] Date of Patent: Feb. 9, 1999

[54] LIGHTED NOVELTY GOLF CLUB WITH AUTOMATED SOUND PRODUCING MEANS

[76] Inventor: Tony L. Keheley, 1188 Highland Dr., Marietta, Ga. 30062

[21] Appl. No.: 17,608

[22] Filed: Feb. 2, 1998

[51] Int. Cl.[6] ..... A63B 69/36

[52] U.S. Cl. ..... 473/220; 473/224; 273/DIG. 14

[58] Field of Search ..... 473/220, 223, 473/224, 234; 273/DIG. 14

[56] References Cited

U.S. PATENT DOCUMENTS

| | | | |
|---|---|---|---|
| 2,903,820 | 9/1959 | Bodell | 273/DIG. 14 |
| 3,254,895 | 6/1966 | Haas . | |
| 3,776,556 | 12/1973 | McLaughlin . | |
| 4,098,509 | 7/1978 | Van Krevelen . | |
| 4,191,378 | 3/1980 | Morin et al. | 473/282 X |
| 4,840,371 | 6/1989 | Harris . | |
| 4,936,582 | 6/1990 | Bernstein . | |
| 5,000,456 | 3/1991 | Rabold . | |
| 5,031,909 | 7/1991 | Pecker | 473/463 |
| 5,050,884 | 9/1991 | Flory . | |
| 5,094,454 | 3/1992 | Schering . | |
| 5,129,650 | 7/1992 | Hayman . | |
| 5,288,080 | 2/1994 | Tice . | |
| 5,339,479 | 8/1994 | Lyman . | |
| 5,374,063 | 12/1994 | Ogden . | |
| 5,544,888 | 8/1996 | Pellegrini . | |

*Primary Examiner*—George J. Marlo
*Attorney, Agent, or Firm*—Kenneth L. Tolar

[57] ABSTRACT

The present invention relates to a novelty golf club having a rigid but flexible club head and a hand grip with a transparent shaft therebetween. Received within the club head is a digital sound chip in communication with a speaker for emitting any one of a plurality of humorous phrases. A plurality of light emitting diodes are received within the transparent shaft and are in communication with a randomizer circuit so that when the lights are illuminated they randomly pulse. The light emitting diodes and voice chip are activated with an impact switch received within the club head immediately adjacent its face. Accordingly, when a user swings the club in frustration and the club head impacts an object, the lights automatically illuminate in a random pattern and the sound chip emits any one of a plurality of humorous sound recordings.

11 Claims, 2 Drawing Sheets

LIGHTED NOVELTY GOLF CLUB WITH AUTOMATED SOUND PRODUCING MEANS

BACKGROUND OF THE INVENTION

The present invention relates to a novelty golf club having randomly pulsing lights within a transparent shaft and a sound producing means within the club head both of which are automatically activated upon the club head striking an object.

DESCRIPTION OF THE PRIOR ART

Golf is a difficult and sometimes frustrating game. When enraged, golfers routinely strike their golf clubs against trees, the ground, a golf cart or other objects often breaking the clubs resulting in significant repair or replacement costs. The impulsive anger or frustration quickly dissipates and the golfer typically regrets having destroyed an expensive club. Accordingly, there is a need for a device which allows a golfer to alleviate frustration without damaging expensive equipment.

Various flexible or rubberized novelty golf clubs exist in the prior art allowing the user to strike the club against an object or bend the club without fear of breaking it. One of these devices has a sound producing means thereon. For example, U.S. Pat. No. 5,544,888 issued to Pellegrini discloses a training device for attaching to a golf club handle that emits a laser beam through the end of the handle opposite the club head so that a golfer can monitor his or her swing.

U.S. Pat. No. 5,374,063 issued to Ogden discloses a golf club apparatus with a light source on the club head that directs light toward a golf ball. A receiver on the club head receives the light that is reflected and activates an indicator light if the club is aligned properly relative to the ball.

U.S. Pat. No. 5,288,080 issued to Tice relates to a practice golf club which has strobe lights mounted on the upper surface of the club head. When the club is swung in a dark room, the strobe lights form a lighted path that briefly hangs in the air allowing the golfer to view a snapshot of his swing plane, angle, path, etc.

U.S. Pat. 5,000,456 issued to Rabold discloses a shortened practice golf club having a light mounted within the grip end and another light mounted within the club head. The lights are designed to improve a golf swing and to teach a golfer to keep his or her eyes focused on the club head.

U.S. Pat. No. 4,936,582 issued to Bernstein discloses a rubber or plastic novelty club that can be bent, twisted or deformed when struck against a tree or the ground. The flexible materials of construction allow the club to be bent back to its original position.

U.S. Pat. No. 4,840,371 issued to Harris discloses a novelty golf club containing a sound producing device in the club head. The sound producing device includes a miniature disc and playing needle that is activated with a reciprocable pin protruding from the club head. Although novelty golf clubs for venting anger are known in the prior art, none of these device have the unique features and advantages of the present invention, specifically, a club that automatically illuminates and emits a humorous phrase upon impact. There is currently a need for a device that not only allows a user to vent anger, but one that quickly interjects humor into an otherwise tense situation. The present invention satisfies such a need by providing an unbreakable club having a digital sound chip within the club head that automatically emits one of a plurality of sound effects upon the club head impacting an object. The present invention further includes a randomizer circuit in communication with a plurality of light emitting diodes. The lights are received within a unique shatterproof shaft and automatically pulse in a random pattern upon the club head impacting an object.

SUMMARY OF THE INVENTION

The present invention relates to a unique novelty golf club having automated sound and light means thereon. The device comprises a rigid but flexible rubber club head having an elongated, transparent shaft attached thereto. Attached to a distal end of the shaft is a rigid but flexible handle component. The handle has an open distal end for receiving a battery means which powers the various components. Received within the club head is a digital sound chip which is pre-programmed with a plurality of humorous or absurd phrases. On the exterior surface of the golf club head is a speaker in communication with the voice chip for audibilizing the output therefrom.

Received within the hollow shaft are a plurality of light emitting diodes (LED's) each in electrical communication with a randomizer circuit which is likewise disposed within the club head. An impact switch is received within the club head immediately adjacent the club face. The impact switch activates the voice chip and light emitting diodes whenever the club face contacts an object. Accordingly, when a user swings the club in frustration and strikes an object, the voice chip will emit any one of a plurality of humorous phrases and the lights will randomly pulse. It is therefore an object of the present invention to provide a novelty golf club having an automated light means integral therewith.

It is yet another object of the present invention to provide a novelty golf club having a sound producing means thereon capable of emitting any one of a plurality of humorous phrases.

It is yet another object of the present invention to provide a novelty golf club in which a light means and sound producing means are activated upon the club head impacting an object.

It is yet another object of the present invention to provide a novelty golf club having a transparent shatterproof shaft for receiving a light means. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
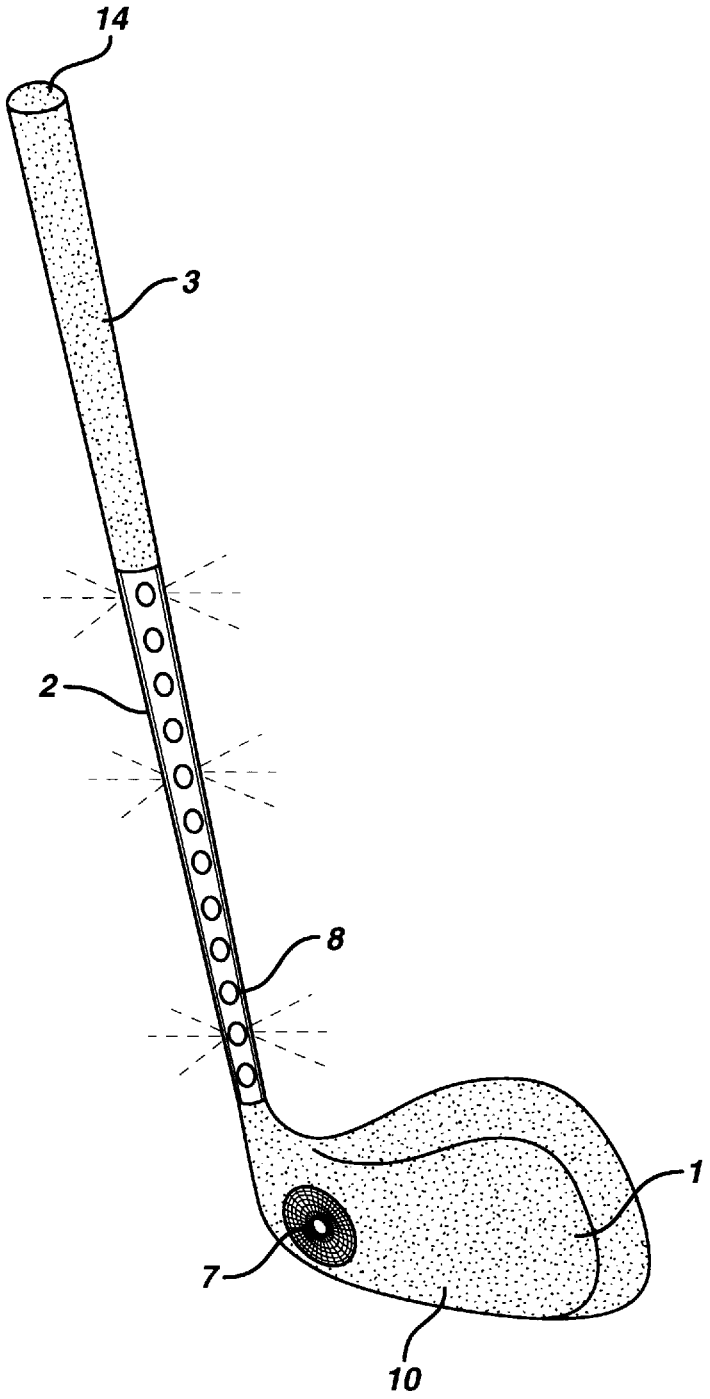
FIG. 1 depicts the inventive device.
Figure 2:
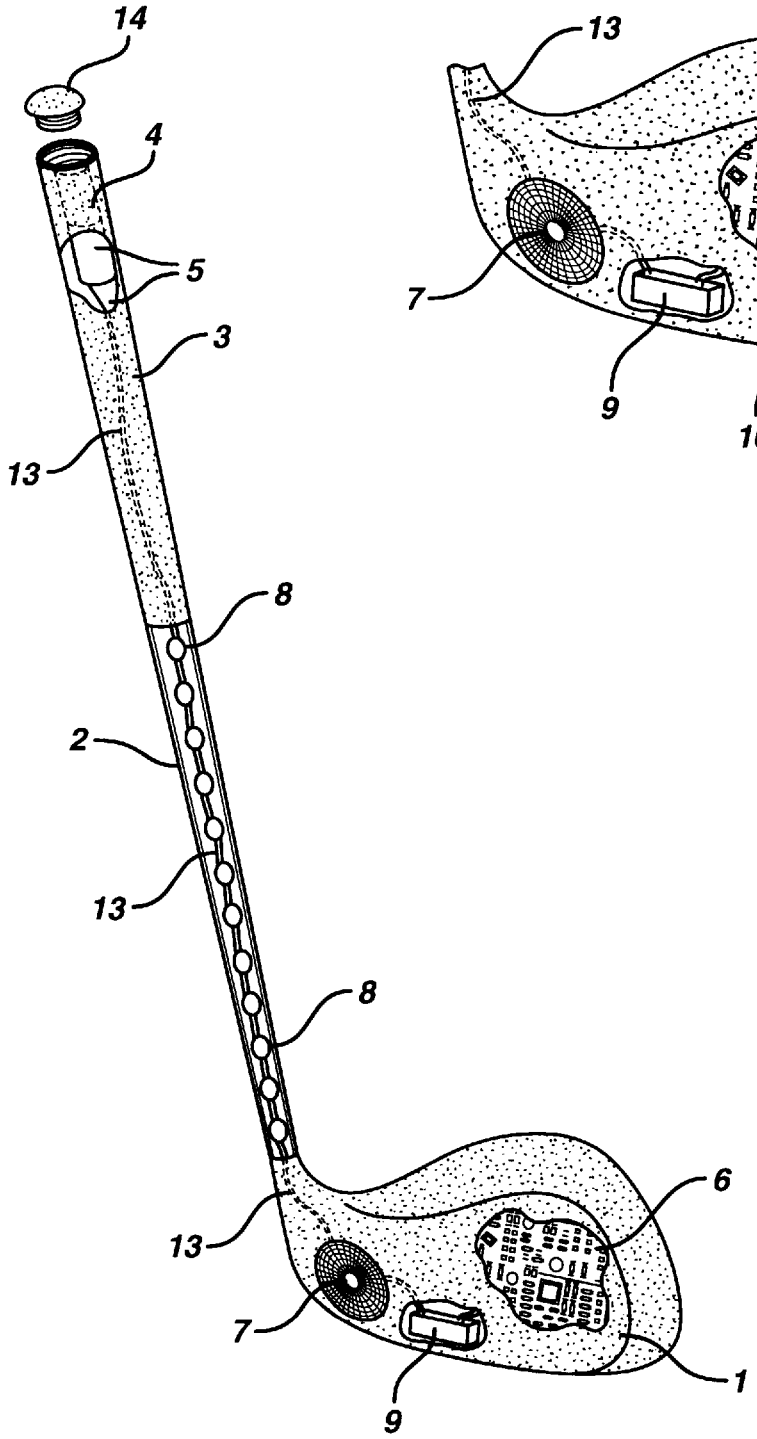
FIG. 2 is a cross-sectional view of the inventive device.
Figure 3:
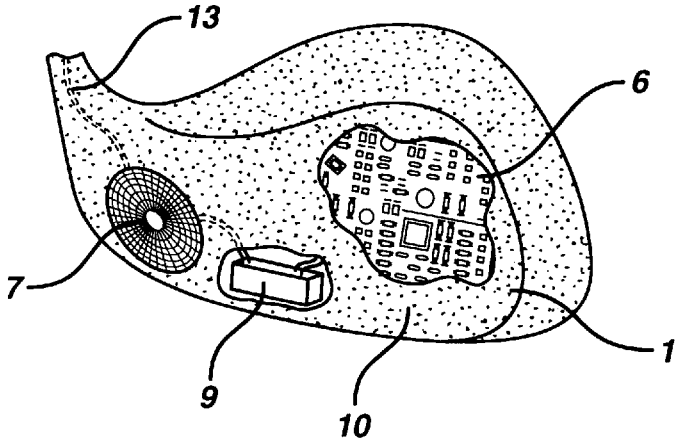
FIG. 3 is a close-up view of the club head further illustrating the internal components thereof.

Referring now to FIGS. 1 through 3, the present invention relates to a novelty golf club which, upon impact, will automatically emit a sound recording and the shaft will be illuminated with pulsing lights. The device comprises a substantially hollow club head 1 with a transparent shaft 2 extending therefrom. The club head preferably has a substantially planar face 10 which is typically used to strike a golf ball. The shaft 2 is preferably made from shatterproof acrylic allowing a frustrated golfer to strike the club against a variety of objects without severing the shaft. Attached to a distal end of the shaft is an elongated hand grip 3 which may be grasped by a user. The hand grip 3 has an open end in communication with a chamber 4 for receiving a battery means 5. The hand grip 3 and club head 1 are preferably constructed with a rigid but flexible rubber material such that the entire golf club is unbreakable.

Received within the club head 1 is a sound chip 6 of the type generally known in the prior art which has been pre-programmed with a plurality of humorous or trivial phrases simulating laughter, sarcastic remarks and similar recordings. The sound chip 6 is in communication with a speaker 7 disposed on the exterior of the club head 1 for audiblizing the output of the sound chip 6.

Received within the transparent shaft are a plurality of light emitting diodes (LED's) 8 for emitting various light patterns therein. In the preferred embodiment, the light emitting diodes are integrally molded within the acrylic shaft. A randomizer circuit (not pictured) is disposed within the club head and is electrically connected to the light emitting diodes 8. Thus, when activated, the LED's will randomly pulse for a predetermined duration.

The LED's 8 and the sound chip 6 are both activated with an electrically connected impact switch 9 of the type generally known in the prior art which is received within the club head and is preferably disposed immediately adjacent the inner side of the club face 10. The lights 8 and sound chip 6 are powered with a battery means 5 which is preferably received within the compartment 4 adjacent the open end of the handle member. Wires 13 run through the transparent shaft for electrically connecting the battery to the lights, the impact switch and sound chip assembly. The open end of the handle member may be selectively closed using a cap 14. The cap may threadedly engage the open end or may be attached using any other conventional attachment means.

Accordingly, a frustrated golfer may pull the club out of his bag and swing it in anger. When the club face impacts an object or the ground, any one of a plurality of humorous phrases will be emitted and the shaft lights will begin flashing in a random pattern thereby neutralizing an otherwise tense situation. Moreover, should the golfer strike the club against a tree or other similar surface, the club will not break.

The present invention is not limited to the exact details described above. The size, shape and materials of construction of the various components may be varied without departing from the spirit of the present invention. For example, various sound producing means of the type generally known in the prior art may be used instead of a sound chip. Varying switch means may be used to activate the lights and sound chip such as a motion responsive switch or similar means. The club depicted in FIGS. 1 through 3 resembles an iron. However, the club may also resemble a putter or a wood.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A novelty golf club comprising:

a substantially hollow club head, said club head having a substantially planar face;

an elongated transparent shaft, having two ends, an end of which is attached to said club head;

a hand grip attached to an opposing end of said shaft;

a sound producing means received within said club head;

light means received within said transparent shaft;

a switch means electrically connected to said sound producing means and said light means for activating said light means and said sound producing means when said club head impacts an object.

2. A novelty golf club according to claim 1 further comprising a randomizer circuit received within said club head and electrically connected to said light means so that, when the light means is activated by said switch means, the lights randomly pulse for a predetermined duration.

3. A novelty golf club according to claim 1 wherein said switch means is an impact switch received within said golf club head immediately adjacent its face.

4. A novelty golf club according to claim 1 wherein said hand grip further comprises:

an open end in communication with an interior chamber;

a battery means received within said chamber electrically connected to said light means, said sound producing means and said switch means for providing electrical power thereto.

5. A novelty golf club according to claim 4 further comprising a cap means removably attached to said open end for selectively enclosing said interior chamber.

6. A novelty golf club according to claim 1 wherein said club head and said hand grips are made from a rigid but flexible material.

7. A novelty golf club according to claim 1 wherein said transparent shaft is fabricated from a shatterproof acrylic material.

8. A novelty golf club according to claim 1 further comprising a speaker disposed on the club head in communication with said sound producing means for audibilizing the output of said sound producing means.

9. A novelty golf club according to claim 1 wherein said sound producing means is a digital sound chip having a plurality of sounds pre-programmed thereon.

10. A novelty golf club according to claim 1 wherein said light means are integrally molded within said shaft.

11. A novelty golf club according to claim 1 wherein said light means includes a plurality of light emitting diodes.

* * * * *